US005811724A

United States Patent [19]

Henry, III et al.

[11] Patent Number: 5,811,724

[45] Date of Patent: Sep. 22, 1998

[54] INFRARED TRACER FOR AMMUNITION

[75] Inventors: Guy H. Henry, III, Marion; Michael A. Owens, Johnson City; Jarrett L. Terry, Carbondale; Mark A. Tucker, Buncombe; Frank M. Bone, Carterville, all of Ill.

[73] Assignee: Primex Technologies, Inc., Marion, Ill.

[21] Appl. No.: 926,376

[22] Filed: Sep. 9, 1997

[51] Int. Cl.[6] ..... C06B 45/10

[52] U.S. Cl. ..... 149/18; 149/19.4; 149/19.6; 149/44; 149/116; 102/335

[58] Field of Search ..... 149/18, 19.4, 19.6, 149/44, 116; 102/335

[56] References Cited

U.S. PATENT DOCUMENTS

| | | | |
|---|---|---|---|
| 3,611,936 | 10/1971 | Bousse et al. . | |
| 3,677,842 | 7/1972 | Doris . | |
| 3,733,223 | 5/1973 | Lohkamp . | |
| 3,750,585 | 8/1973 | Feldman . | |
| 3,780,658 | 12/1973 | de Longueville et al. | 102/518 |
| 3,982,930 | 9/1976 | Doades | 149/124 |
| 4,402,776 | 9/1983 | Whipps . | |
| 4,597,810 | 7/1986 | Trickel et al. . | |
| 4,719,857 | 1/1988 | Spring . | |
| 5,361,701 | 11/1994 | Stevens | 102/450 |
| 5,472,536 | 12/1995 | Doris et al. . | |
| 5,587,552 | 12/1996 | Dillehay et al. . | |
| 5,639,984 | 6/1997 | Nielson . | |

OTHER PUBLICATIONS

Albert J. Mastrangelo "Screening of Metal Powders" appearing in *Metals Handbook® Ninth Edition*, vol. 7, pp. 176–177 (1984).

*Primary Examiner*—Edward A. Miller
*Attorney, Agent, or Firm*—Gregory S. Rosenblatt; Wiggin & Dana

[57] ABSTRACT

A pyrotechnic composition that emits essentially only infrared radiation upon combustion contains at least one peroxide component, an oxidizer that is more energetic than the peroxide component, a coolant, a binder and silicon. In one embodiment, the peroxide component is a mixture of strontium peroxide and barium peroxide, the oxidizer more energetic than the peroxide component is barium nitrate, the coolant is magnesium carbonate, the binder is calcium resonate and the silicon has a minimum purity of 99.9%. The pyrotechnic composition is useful as the combustible component of an infrared tracer.

16 Claims, No Drawings

INFRARED TRACER FOR AMMUNITION

STATEMENT AS TO RIGHTS TO INVENTION

This invention was developed under Contract Number DAAD05-96-C-9016 awarded by the United States Army. Rights in this invention were retained by the Assignee as provided for by the terms of that Contract.

BACKGROUND OF THE INVENTION

1. Field of the Invention

This invention relates to a tracer composition having an infrared radiation output. More particularly, a combination of the tracer composition and particulate size extends the burn time and reduces the visible output.

2. Description of the Related Art

Ammunition shells containing a combustible tracer composition are used by gunners to determine a proper firing trajectory. One type of tracer composition has an infrared signature. On combustion, the tracer composition generates infrared radiation, with a typical wavelength of between 2.5 and 14 microns. Very little of the tracer combustion output is in the visible light range. The gunner, or an observer teamed with the gunner, can view the infrared emission through night vision goggles or other system sensitive to infrared output. The absence of an output in the visible spectrum makes it difficult for an enemy to determine the gunner's location.

One infrared tracer composition, developed by the United States Army, is designated R-440. This composition, a mixture of barium peroxide, strontium peroxide, calcium resonate and magnesium carbonate, is disclosed in U.S. Pat. No. 3,677,842 to Doris, Jr. that is incorporated by reference in its entirety herein.

The R-440 formulation tends to burn quite quickly. The volume of tracer composition contained in a standard 30 millimeter shell is consumed in about 5 seconds. Modem ammunition trajectories sometimes require a flight time in excess of 5 seconds reducing the efficacy of the R-440 tracer mix. Additionally, the R-440 tracer mix combustion output is partially in the visible spectrum, possibly placing the gunner at risk.

U.S. Pat. No. 5,639,984 to Nielson discloses a covert infrared tracer composition with a combustion output that is disclosed to be essentially free of visible emissions. This composition contains a mixture of an alkaline metal compound, a burn rate catalyst, at least one peroxide and a binder. The Nielson patent is incorporated by reference in its entirety herein.

The composition disclosed in the U.S. Pat. No. 5,639,984 is formed into 500 micron–800 micron sized particles by a solvent evaporation process. Such a "wet" process is time consuming and increases the cost of the tracer mix. In addition, this tracer mix burns at about the same rate, or faster, than the R-440 tracer mix.

There remains, therefore a need for a tracer composition that has an infrared output substantially free of visible light that is both economical to produce and has a burn rate superior to R-440.

SUMMARY OF THE INVENTION

Accordingly, it is an object of the invention to provide a combustible tracer mix that emits substantially entirely infrared radiation on burning. It is a feature of the invention that the tracer composition is a mixture of oxidizers, fuels and burn rate modifiers. Each component of the tracer mix is provided in a specified amount and a specified particulate size. Another feature of the invention is that the constituents of the tracer composition are preferably mixed dry, without the necessity of adding a solvent, and then compacted.

Among the advantages of the tracer composition of the invention are that the composition has a burn time considerably longer than that of R-440 and an output that is substantially within the infrared spectrum. A further advantage is that due to the dry processing, the tracer composition may be manufactured economically in large quantities.

In accordance with the invention, there is provided a pyrotechnic composition that has an output of substantially infrared radiation on combustion. By weight, the composition consists essentially of from about 20% to about 90% of at least one peroxide component, from about 1% to about 20% of an oxidizer that is more energetic than the peroxide component, from about 5% to about 15% of a burn rate modifier, from about 5% to about 15% of a binder and from about 0.1% to about 11% of silicon.

The above stated objects, features and advantages will become more apparent from the specification and drawings that follow.

DETAILED DESCRIPTION

The pyrotechnic composition of the invention has, as a first constituent, at least one peroxide component. Suitable peroxide components include strontium peroxide, barium peroxide, potassium peroxide, ammonium peroxide, sodium peroxide and mixtures thereof, with strontium peroxide, barium peroxide and mixtures thereof being preferred. The peroxide component content should be at least about 35% by weight and less than about 90% by weight. If the peroxide component is present in an amount of either less than about 35% or more than about 90%, then the oxygen to fuel ratio will not support proper ignition or burn characteristics. The peroxide component may be made up of more than one peroxide such as a mixture of strontium peroxide and barium peroxide. One exemplary tracer composition contains strontium peroxide and barium peroxide in a weight percent ratio of about 1:1.

A second component is an oxidizer that is more energetic than the peroxide component. The energetic oxidizer increases the reliability of the burn without increasing the visible output of the tracer and without providing an unacceptably large increase in infrared output that could overwhelm the infrared detection system. A preferred energetic oxidizer is barium nitrate. Other suitable energetic oxidizers include ammonium perchlorate, potassium perchlorate, sodium nitrate, ammonium nitrate, guanidine nitrate and strontium nitrate.

The minimum quantity of energetic oxidizer is about 1%. In concentrations less than about 1% the ignition reliability becomes suspect. When the concentration of the energetic oxidizer exceeds about 20%, then the combustion products become visible.

The next constituent of the pyrotechnic composition is a coolant present in an amount of from about 5% to about 15%. One preferred coolant is magnesium carbonate. Other suitable coolants include the oxalate family of compounds such as ammonium oxalate, strontium oxalate, sodium oxalate, barium oxalate, calcium oxalate and mixtures thereof.

When the coolant content is less than about 5%, the combustion products are visible. When the coolant content exceeds about 15%, the tracer composition has poor burning characteristics.

A binder maintains the other constituents of the pyrotechnic composition, that are provided in particle form, together. The binder is selected to conform to the other constituents at a pressure of less than about 85,000 psi. One preferred binder is calcium resonate. Other suitable binders include polymers such as polyurethanes and epoxies. These binders increase the structural integrity of the tracer material.

The binder is present in an amount of from about 5% to about 15%. When the binder content is either below about 5% or exceeds about 15%, the binder does not maintain the integrity of the tracer composition in flight and break-up of the tracer may result.

Another component of the pyrotechnic composition is silicon having a purity of at least 98%, by weight, and preferably having a purity in excess of 99.9%, by weight. The silicon is preferably in an amorphous form. High purity silicon is required since impurities in the silicon tend to produce visible emissions on combustion.

The silicon effectively increases the burn intensity of the tracer composition, improving burn reliability. Preferably, the silicon is present in an amount of from about 0.1% to about 15%. When the silicon content is less than about 0.1% the tracer composition burns erratically. When the content exceeds 15% the tracer composition burns to quickly.

The constituents of the pyrotechnic composition are provided as relatively small particles. Since the particles are of random shape, the particle size is determined by passing the particulate through a sieve and identifying the largest number sieve through which the particles would fall. For the peroxide component, the particles should pass through a number 100 sieve, maximum dimension about 149 microns. The oxidizer that is more energetic than the peroxide component should be slightly smaller than the peroxide component and pass through a 140 mesh sieve, for a maximum particle size of about 105 microns. The coolant may be somewhat larger, passing through a 35 mesh sieve for a maximum particle size of about 400 microns. The binder should pass through an 80 mesh sieve for a maximum particle size of about 177 microns and the silicon should pass through a 100 mesh screen for maximum particle size of about 149 microns.

The use of relatively small particulate for the constituents of the pyrotechnic composition facilitates both intimate mixing of the constituents and a consistent burn rate throughout the entire pyrotechnic composition. The constituents are combined in their desired proportions and mixed in a cone blender, or equivalent, until a substantially homogeneous composition is achieved. Typically mixing for from about 30 minutes to about 2 hours will achieve the desired degree of homogeneity. The tracer constituents can be mixed dry, or wet—with the inclusion of a solvent to be subsequently evaporated.

The tracer mixture is then compacted into an ammunition shell of a desired caliber. Preferably, the ammunition shell is steel and compaction is by a hydraulic press in a two-stage process. Approximately one half of the tracer mixture is compacted at a first pressure and then the second half is added to the shell and compacted at a second, lower, pressure. Increasing the pressure of the first portion decreases the burn rate of that portion. Exemplary compaction pressures are 85,000 psi for the first portion and 72,000 psi for the second portion. When the shell is fired, the tracer composition is ignited by hot gases emitted by a propellant.

A preferred pyrotechnic composition having an infrared output consists essentially, by weight, of:

strontium peroxide: 19.5%–49.5% barium peroxide: 19.5%–49.5% magnesium carbonate: 5%–15% calcium resonate: 5%–15% silicon: 0.1%–11% barium nitrate: 1%–20%

A more preferred composition for the tracer is, by weight:

strontium peroxide: 32%–36% barium peroxide: 32%–36% magnesium carbonate: 8%–12% calcium resonate: 8%–12% silicon: 0.5%–1.5% barium nitrate: 8%–12%

The advantages of the tracer composition of the invention will become more apparent from the Example that follows:

EXAMPLE

A homogeneous mixture of tracer composition having the nominal composition, by weight, of:

strontium peroxide 34.5%; barium peroxide 34.4%; magnesium carbonate 10%; calcium resonate 10%; silicon 1% and barium nitrate 10%, with particle sizes as specified above, was hydraulically loaded into 30 millimeter steel ammunition shells. Each shell weighed 240 grams and contained about 5.5 grams of tracer composition. One group of 20 shells was heated to +60° C. (+140° F.) and a second group of 20 shells was cooled to −32° C. (−25° F.) and maintained at temperature for a minimum of 2 hours to achieve equilibrium. The shells were then fired and the percentage of no-fires recorded.

The burn time was then determined by spotters wearing infrared goggles using a stop watch to time the interval from the appearance of an infrared emission to the end of the emission. Another spotter, without infrared goggles would determine the presence of any emission in the visible spectrum. The results are as indicated in Table 1.

TABLE 1

| TEMPERATURE | BURN TIME | NO-FIRES | VISIBLE EMISSION |
|---|---|---|---|
| 140° F. | 8.34 seconds | 0 | no |
| −25° F. | 11.18 seconds | 0 | no |

The tracer composition of the invention was then compared to both the R-440 and a composition as described in U.S. Pat. No. 5,639,984. As indicated in Table 2, the tracer composition of the present invention is an improvement over both of the prior compositions.

TABLE 2

| TRACER COMPOSITION | TEMPERATURE | BURN TIME | NO-FIRES | VISIBLE OUTPUT |
|---|---|---|---|---|
| R-440 | 140° F. | 5.47 seconds | 25% | yes |
| R-440 | −25° F. | 4.72 seconds | 40% | yes |
| 5,639,984 | 140° F. | 1.62 seconds | 0 | no |
| 5,639,984 | −25° F. | 3.35 seconds | 0 | no |

It is apparent that there has been provided in accordance with this invention a tracer composition that fully satisfies the objects, features and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A pyrotechnic composition having output that is substantially infrared radiation on combustion, consisting essentially of, by weight, of:

from about 15% to about 90% of at least one peroxide component;

from about 1% to about 20% of an oxidizer that is more energetic than said peroxide component;

from about 5% to about 15% of a coolant;

from about 5% to about 15% of a binder; and from about 0.1% to about 15% of silicon.

2. The pyrotechnic composition of claim 1 wherein said at least one peroxide component is selected from the group consisting of strontium peroxide, barium peroxide, potassium peroxide, ammonium peroxide, sodium peroxide and mixtures thereof.

3. The pyrotechnic composition of claim 2 wherein said at least one peroxide component is a mixture of strontium peroxide and barium peroxide.

4. The pyrotechnic composition of claim 1 wherein said oxidizer more energetic than said peroxide component is selected from the group consisting of barium nitrate, ammonium perchlorate, potassium perchlorate, sodium nitrate, ammonium nitrate, guanidine nitrate, strontium nitrate, and mixtures thereof.

5. The pyrotechnic composition of claim 4 wherein said oxidizer more energetic than said peroxide component is barium nitrate.

6. The pyrotechnic composition of claim 1 wherein said coolant is selected from the group consisting of magnesium carbonate, ammonium oxalate, strontium oxalate, sodium oxalate, barium oxalate, calcium oxalate and mixtures thereof.

7. The pyrotechnic composition of claim 6 wherein said coolant is magnesium carbonate.

8. The pyrotechnic composition of claim 1 wherein said binder is selected from the group consisting of calcium resonate, polyurethanes and epoxies.

9. The pyrotechnic composition of claim 1 wherein said binder is calcium resonate.

10. The pyrotechnic composition of claim 1 wherein the at least one peroxide component has a maximum particle size of about 149 microns, said oxidizer more energetic than said peroxide component has a maximum particle size of about 105 microns, said coolant has a maximum particle size of about 400 microns, said binder has a maximum particle size of about 177 microns and said silicon has a maximum particle size of about 149 microns.

11. The pyrotechnic composition of claim 10 wherein said at least one peroxide component is selected from the group consisting of strontium peroxide, barium peroxide, potassium peroxide, ammonium peroxide, sodium peroxide and mixtures thereof, said oxidizer more energetic than said peroxide component is selected from the group consisting of barium nitrate, ammonium perchlorate, potassium perchlorate, sodium nitrate, ammonium nitrate, guanidine nitrate, strontium nitrate, and mixtures thereof, said coolant is selected from the group consisting of magnesium carbonate, ammonium oxalate, strontium oxalate, sodium oxalate, barium oxalate, calcium oxalate and mixtures thereof and said binder is selected from the group consisting of calcium resonate, polyurethanes and epoxies.

12. The pyrotechnic composition of claim 11 wherein said at least one peroxide component is a mixture of strontium peroxide and barium peroxide, said oxidizer more energetic than said peroxide component is barium nitrate, said coolant is magnesium carbonate and said binder is calcium resonate.

13. A pyrotechnic composition having an output that is substantially infrared radiation upon combustion, consisting essentially, by weight, of:

from about 19% to about 49% of strontium peroxide;

from about 19% to about 49% of barium peroxide;

from about 5% to about 15% of magnesium carbonate;

from about 5% to about 15% of calcium resonate;

from about 0.1% to about 15% of silicon; and from about 1% to about 20% of barium nitrate.

14. The pyrotechnic composition of claim 13 consisting essentially, by weight, of:

from about 32% to about 36% of strontium peroxide;

from about 32% to about 36% of barium peroxide;

from about 8% to about 12% of magnesium carbonate;

from about 8% to about 12% of calcium resonate;

from about 0.5% to about 1.5% of silicon; and from about 8% to about 12% of barium nitrate.

15. The pyrotechnic composition of claim 13 wherein said strontium peroxide, said barium peroxide and said silicon have a maximum particle size of about 149 microns, said barium peroxide has a maximum particle size of about 105 microns, said magnesium carbonate has a maximum particle size of about 400 microns and said calcium resinate has a maximum particle size of about 177 microns.

16. The pyrotechnic composition of claim 15 consisting essentially, by weight, of:

from about 32% to about 36% of strontium peroxide;

from about 32% to about 36% of barium peroxide;

from about 8% to about 12% of magnesium carbonate;

from about 8% to about 12% of calcium resonate;

from about 0.5% to about 1.5% of silicon; and from about 8% to about 12% of barium nitrate.

* * * * *